US005180229A

United States Patent [19]

Niemeyer

[11] Patent Number: 5,180,229

[45] Date of Patent: Jan. 19, 1993

[54] SAMPLING BAG WITH ENCLOSED WIRE ENDS

[75] Inventor: William P. Niemeyer, Fort Atkinson, Wis.

[73] Assignee: Nasco International, Inc., Fort Atkinson, Wis.

[21] Appl. No.: 666,581

[22] Filed: Mar. 8, 1991

[51] Int. Cl.[5] ..... B65D 33/30

[52] U.S. Cl. ..... 383/91; 383/209

[58] Field of Search ..... 383/91, 905, 209

[56] References Cited

U.S. PATENT DOCUMENTS

| | | | |
|---|---|---|---|
| 1,979,157 | 10/1934 | Higginbottom | 383/91 |
| 2,071,745 | 2/1937 | Higginbottom | 383/91 |
| 2,590,462 | 3/1952 | Rassenfoss | 383/91 X |
| 2,973,131 | 2/1961 | Mead et al. | 383/91 |
| 3,189,253 | 6/1965 | Mojonnier | 383/91 X |
| 4,301,925 | 11/1981 | Bogart | 383/905 X |
| 4,356,954 | 11/1982 | Mojonnier | 383/905 X |

*Primary Examiner*—Allan N. Shoap
*Assistant Examiner*—Jes F. Pascua
*Attorney, Agent, or Firm*—Andrus, Sceales, Starke & Sawall

[57] ABSTRACT

A sampling bag such as for sampling of liquids or other material is provided with an improved wire-type closure. A pair of wires are connected to the front and rear walls of the bag, and extend outwardly beyond the side edges of the bag. Facing adhesive strips are secured to the front and rear walls of the bag along the length of the wires, and the ends of the adhesive strips extend beyond the ends of the wires. The adhesive strips are secured to each other beyond the wire ends, to enclose the wire ends. In this manner, contact of the wire ends with the walls of the bag is prevented when the wire ends are bent inwardly to close the bag.

5 Claims, 2 Drawing Sheets

SAMPLING BAG WITH ENCLOSED WIRE ENDS

BACKGROUND OF THE INVENTION

This invention relates to a bag such as for containing a sample of a material, in which the bag is provided with a wire-type closure.

A sampling bag, such as for containing a liquid sample, is disclosed in U.S. Pat. 2,973,131 to Mead et al, which is assigned to a predecessor of the assignee of the present application. The sampling bag disclosed in the noted patent is highly satisfactory for containing a sample, and has met with great commercial success.

The sampling bag shown in the Mead et al patent is formed of a front wall and rear wall joined together to form an internal cavity in which liquid sample, or a sample of any other material, is placed. An opening is formed between the front and rear walls at the top of the bag, for providing access to the internal cavity. A wire-type closure is secured to the bag adjacent the top opening. The closure consists of a pair of wires, with one wire being connected to each wall of the bag. The wires extend outwardly past the side edges of the bag. Adhesive strips secure the wires to the front and rear walls of the bag, and adhere to each other outwardly of the side edges of the bag so as to encapsulate the wires therebetween. The adhesive strips and wires cooperate to form a tab extending from each side of the bag. The adhesive strips have a length equal to that of the wires.

A problem with the closure described above is that the wire ends can become exposed. When the tabs formed on each side of the bag are bent inwardly to close the bag opening after the sample has been placed into the bag, it is possible for the wire ends to come into contact with the walls of the bag. This may puncture the wall, resulting in the sampled material leaking from the internal cavity of the bag.

The present invention has as its object to address the noted problem, namely the possibility that the wire ends may come into contact with the walls of the bag.

It is another object of the invention to provide a simple and easily carried out structure and method for enclosing the wire ends of a closure as described.

In accordance with the invention, a bag is formed of a flexible front wall and a flexible rear wall, with the walls defining an internal cavity and a top opening providing access to the internal cavity. A deformable wire is connected to and extends laterally from each side of the bag, with the wire terminating in a pair of wire ends each spaced outwardly from a side edge of the bag. The wire ends are adapted to be bent inwardly to close the open top of the bag. A wire cover is connected to the wire outwardly of the side edges of the bag. The wire cover extends beyond each wire end, to enclose the wire ends and thereby prevent contact of the wire ends with the bag walls when the wire ends are bent inwardly to close the open top of the bag. The deformable wire extends throughout the width of the bag. In one form of the invention, a pair of wires are connected to the bag one to each wall, with the pair of wires being coextensive. The cover acts to enclose the ends of both of the wires. The cover preferably encases the portions of the wire extending outwardly from the side edges of the bag, and also extends across the bag to enclose the portion of the wire disposed against the bag wall. In one form of the invention, the cover comprises an adhesive strip fastened to a wall of the bag for sandwiching the wire therebetween, with the adhesive strip extending along with the wire laterally outwardly from the sides of the bag beyond the wire ends. An adhering element is secured to the adhesive strip outwardly of the sides of the bag and beyond the wire ends, for enclosing the wire ends and encasing that portion of the wire extending outwardly from the sides of the bag. When a pair of wires are connected one to each wall of the bag, the adhering element comprises a second adhesive strip which is coextensive with and faces the first-mentioned adhesive strip. The second adhesive strip is located over the second wire, and cooperates with the first-mentioned adhesive strip to encase the portions of the wires extending outwardly from the sides of the bag and to enclose the wire ends. The first-mentioned and second adhesive strips extend beyond the wire ends, and when adhered together protectively enclose the wire ends.

The wires may be secured to the bag prior to application of the adhesive strips, to maintain proper positioning of the wires before the adhesive strips are placed thereover. In the form of the invention disclosed, the wires are secured to the bag walls by secondary, or inner, adhesive strips. The inner adhesive strips are coextensive with the wires. The inner adhesive strips maintain each wire against a wall of the bag, and are secured to each other along the length of the wires located outwardly of the sides of the bag. The primary outer adhesive strips, discussed previously, sandwich the inner adhesive strips against the walls of the bag, and encase the wires and inner adhesive strips laterally outwardly of the sides of the bag.

The invention further contemplates a method of applying a wire closure to a bag, substantially in accordance with the foregoing summary.

Various other features, advantages and objects of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
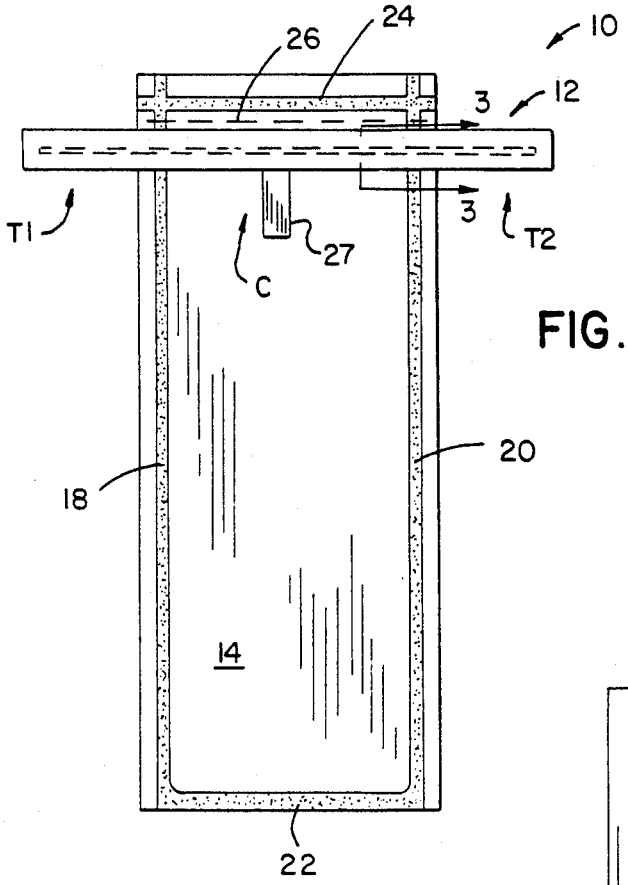
FIG. 1 is an elevation view of a sampling bag incorporating a closure constructed according to the invention.
Figure 3:
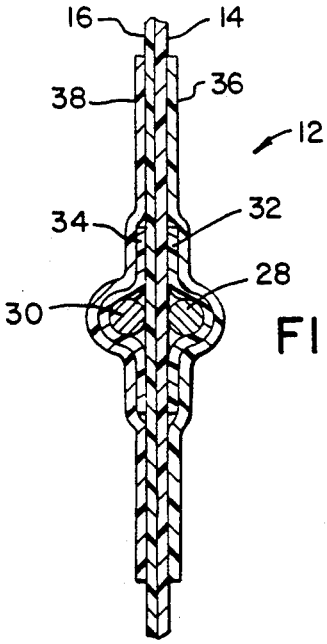
FIG. 3 is a partial sectional view taken generally along line 3—3 of FIG. 1.

FIG. 1 illustrates a sample bag 10 having a wire-type closure 12 constructed according to the invention applied thereto. Bag 10 is formed of a front wall 14 and a rear wall 16 (FIG. 3). Walls 14, 16 are formed of a polyethylene material, and may have a thickness ranging from $1\frac{1}{4}$ to 4 mils. Walls 14, 16 are bonded together in any satisfactory manner along a pair of side seams 18, 20, with a bottom seam 22 extending between side seams 18, 20 at their lower ends. Alternatively, bag 10 may be constructed from tubular stock. In any event, an internal cavity is formed between front and rear walls 14, 16 of bag 10 for receiving an object or a material therewithin.

A top seam 24 extends between side seams 18, 20 adjacent the upper ends thereof, and a perforation 26 extends across the width of front and rear walls 14, 20 between upper seam 24 and closure 12.

With the arrangement as described, the portion of bag 10 located above perforation 26 is removed by a user so as to form an opening in the top portion of bag 10, with the opening providing access to the internal cavity of bag 10 disposed between front and rear walls 14, 16. In this manner, sterility of the inner surfaces of walls 14, 16 forming the internal cavity of bag 10 can be maintained prior to use of bag 10.

Bag 10 may be employed in a variety of uses for containing an object or material, whether liquid or solid. A common application for bag 10 is sampling of milk, or any other liquid, during processing.

Referring to FIG. 1, closure 12 generally comprises a central portion C which extends across the width of front and rear walls 14, 16 of bag 10, and a pair of end tabs T1, T2 extending outwardly from central portion C past the side edges of bag 10.

A pull tab 27 is connected to closure 12 at front wall 14, and a similar pull tab (not shown) is provided at rear wall 16. The pull tabs, such as shown at 27, are grasped between the user's fingers to open bag 10 after the portion above perforation 26 is removed.

To use a bag such as that shown and described, a user first removes the material above perforation 26 and opens the bag by pulling the pull tabs, such as 27, outwardly. The sample is then placed into the bag, and tabs T1, T2 are pulled in opposite directions to close the bag. The bag is then "whirled" while tabs T1, T2 are gripped, to seal the bag, and tabs T1, T2 bent inwardly to maintain the bag sealed.

Referring to FIG. 3, closure 12 consists of a wire 28 positioned against the outer surface of front wall 14, and a wire 30 positioned against the outer surface of rear wall 16. Across the width of front and rear walls 14, 16, wires 28 and 30 are at substantially the same vertical position on bag 10.

An inner adhesive strip 32 is positioned over front wire 28 such that wire 28 extends substantially along the center line of strip 32. The upper and lower portions of adhesive strip 32 are secured to the outer surface of front wall 14 above and below wire 28. Adhesive strip 32 may be of any satisfactory construction, providing an adhesive connectable to the material of front wall 14, and may be that such as manufactured by Cortape, Inc. of Cuyahogo Falls, Ohio under its designation "Plastic PVC Tape", $\frac{1}{8}$ in.×180 yd. roll. In a similar manner, in inner adhesive strip 34 is secured to the outer surface of rear wall 16, so as to sandwich rear wire 30 between adhesive strip 34 and rear wall 16.

An outer front adhesive strip 36 is secured to the outer surface of front wall 14 outwardly of inner adhesive strip 32. Outer adhesive strip 36 has its upper and lower portions extending above and below the upper and lower extent, respectively, of inner adhesive strip 32, so as to encapsulate inner adhesive strip 32 and front wire 18 against the outer surface of front wall 14. In a similar manner, an outer rear adhesive strip 38 is secured to the outer surface of rear wall 16, encapsulating inner rear adhesive strip 34 and rear wire 30. Outer adhesive strips 36, 38 again may be of any satisfactory construction, providing an adhesive suitable for connection to the material of front and rear walls 14, 16, and may be that such as manufactured by Cortape, Inc. of Cuyahogo Falls, Ohio under its designation "Plastic PVC Tape", $\frac{3}{8}$ in.×360 yd. roll or American Tape of Marysville, Mich., under its designation "PC1", 0.300 in.×360 yd. roll.

Figure 2:
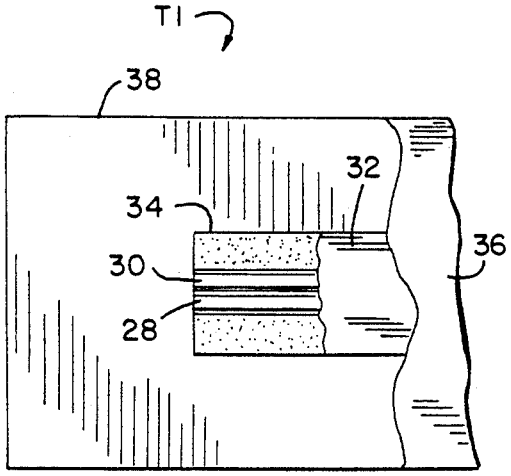
FIG. 2 is an enlarged partial elevation view of the end portion of the bag closure shown in FIG. 1, with a portion broken away.

FIG. 2 illustrates the outer portion of tab T1, which extends leftwardly from bag 10 as shown in FIG. 1. It is to be understood that tab T2 is similar in construction to tab T1, being a mirror image thereof.

Tab T1 consists of front wire 28 and rear wire 30, which are positioned one on top of the other outwardly of the side edges of bag 10. FIG. 2 illustrates the adhesive surface of inner rear adhesive strip 34 which, along the width of rear wall 16, secures rear wire 30 thereto. Outwardly of the side edges of bag 10, inner rear adhesive strip 34 faces and contacts inner front adhesive strip 32, with wires 28, 30 disposed therebetween. Inner front and rear adhesive strips 32, 34, respectively, are coextensive with front and rear wires 28, 30.

Outer front and rear adhesive strips 36, 38, respectively, extend laterally outwardly of the ends of wires 28, 30 and inner adhesive strips 32, 34. Throughout the width of front and rear walls 14, 16, outer adhesive strips 36, 38, respectively, are secured to walls 14, 16. Outwardly of the side edges of bag 10, outer front and rear adhesive strips 36, 38 face and are secured to each other, so as to encapsulate inner adhesive strips 32, 34 and wires 28, 30.

The portion of outer adhesive strips 36, 38 which adhere to each other outwardly of the ends of wires 28, 30 act to enclose the ends of wires 28, 30. Such enclosure of the wire ends prevents the wire ends from contacting front or rear walls 14, 16 when tabs T1, T2 are bent inwardly thereagainst when it is desired to close the open top of bag 10 after the sample is placed in its internal cavity and bag 10 is "whirled" shut. In this manner, accidental puncturing of walls 14, 16 is prevented.

It has been found that with prior art wire-type closures, in which the adhesive strips are coextensive with the wire ends, it is not uncommon for the wire ends to project past the ends of the adhesive strips when the tabs are bent inwardly to close the bag. With the arrangement as shown and described, the ends of wires 28, 30 simply slide between outer adhesive strips 36, 38 during inward bending of tabs T1, T2. In this manner, projection of the wire ends beyond the ends of outer adhesive strips 36, 38 is prevented during inward bending of tabs T1, T2.

In addition, when thermoplastic adhesive strips have been used in prior art closures, the thermoplastic material can contract during sterilization of the bag, which may again result in the wire ends becoming exposed. With the arrangement of the invention, inner strips 32, 34 and outer strips 36, 38 can be formed of a thermoplastic material. The contraction which can result from sterilization simply causes strips 36, 38 to slide over the ends of wires 28, 30, with strips 36, 38 adhering to each other outwardly of the wire ends to enclose the wire ends.

Figure 4:
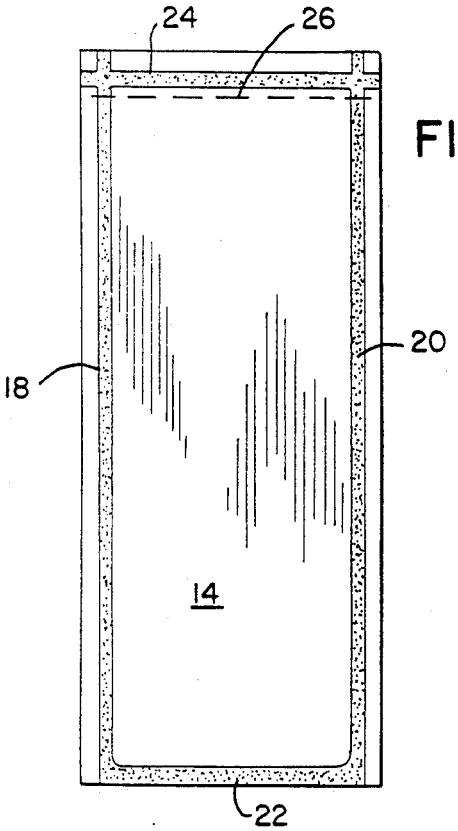
FIGS. 4–8 show in step-by-step fashion the manner in which the closure of FIG. 1 is applied to the bag.
Figure 5:
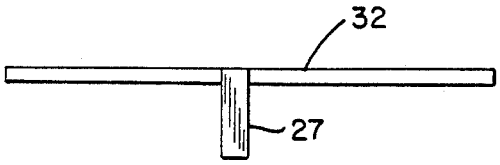
Figure 6:
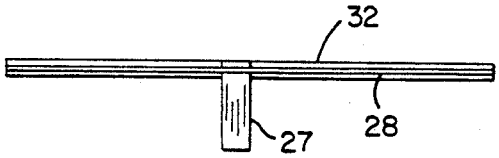
Figure 7:
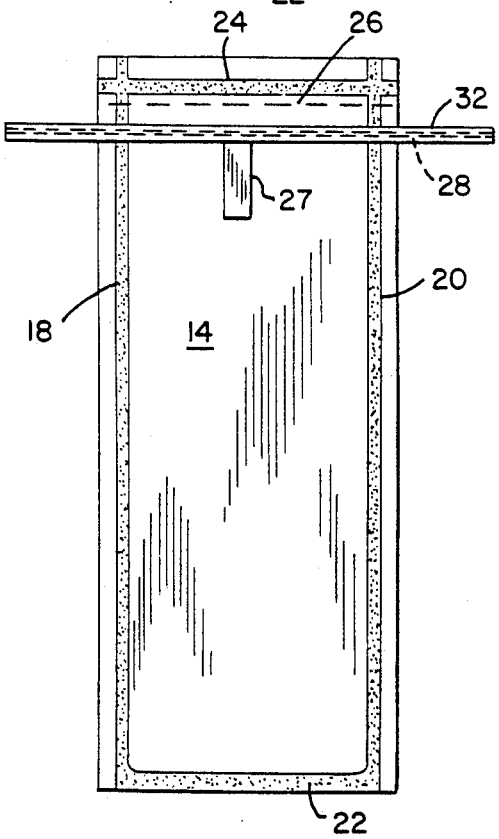

Reference is now made to FIGS. 4–8, which illustrate the manner in which closure 12 is applied to bag 10. FIG. 4 illustrates a blank of bag 10, in which side seams 18, 20, bottom seam 22, top seam 24 and perforation 26 are formed. In FIG. 5, pull tab 27 is connected to inner front adhesive strip 32, with the adhesive of strip 32 securing pull tab 27 thereto. After pull tab 27 is connected to the adhesive surface of inner front adhesive strip 32, front wire 28 is then applied thereto, as shown in FIG. 6. As noted previously, inner front adhesive strip 32 is coextensive with front wire 28. Referring to FIG. 7, the assembled front wire 28 and inner front adhesive strip 32 are then applied, adhesive side down, to front wall 14 of bag 10. Pull tab 27 is located approximately at the centerline of bag 10. While the above-noted step of applying inner front adhesive strip 32 to front wall 14 is taking place, an identical assembly consisting of rear wire 30 and inner rear adhesive strip 34 is being applied to rear wall 16 of bag 10 at the same vertical location as the assembly secured to front wall 14. In this manner, front and rear inner adhesive strips 32, 34 face and are secured to each other outwardly of the side edges of bag 10, so as to encase the end portions of wires 28, 30.

Figure 8:
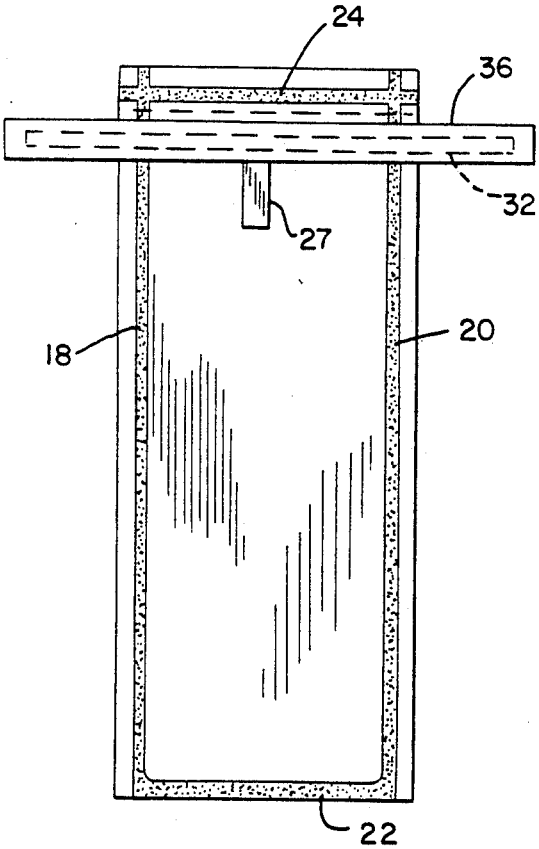

Referring to FIG. 8, outer front adhesive strip 36 is then applied to front wall 14 over inner front adhesive strip 32, and outer rear adhesive strip 38 is simultaneously applied to rear wall 16 of bag 10 over rear wire 30 and inner rear adhesive strip 34, at the same vertical position as outer front adhesive strip 36. In this manner, the end portions of outer front and rear adhesive strips 36, 38 face and are secured to each other so as to encapsulate the end portions of inner front and rear adhesive strips 32, 34 and inner and outer wires 28, 30. As noted previously, front and rear outer adhesive strips 36, 38 extend beyond the ends of wires 28, 30 and inner adhesive strips 32, 34, and are secured to each other so as to enclose the ends of wires 28, 30.

In a prototype construction, outer front and rear adhesive strips 36, 38 extend approximately 3/16-inch beyond the ends of wires 28, 30. This arrangement has been found satisfactory to prevent the ends of wires 28, 30 from projecting outwardly past outer adhesive strips 36, 38 upon inward bending of tabs T1, T2 to close bag 10.

Various alternatives and embodiments are contemplated as being within the scope of the following claims particularly pointing out and distinctly claiming the subject matter regarded as the invention.

I claim:

1. In a sampling bag including a front wall and a rear wall joined together along a pair of spaced side edges and a bottom edge to define a cavity, the bag having a removable upper portion adapted to define an opening disposed between the top edges of the front and rear walls, and further having a pair of deformable wire portions extending one from each side edge of the bag and terminating in a wire end, the wire portions being adapted to be bent inwardly to close the top opening of the bag, the improvement comprising a wire cover connected to each wire portion adjacent its wire end and extending past the wire end to enclose the wire end and prevent its contact with the front and rear walls of the bag when the wires are bent inwardly to close the top opening of the bag, wherein the deformable wire portions are connected to the wall of the bag by means of an inner adhesive strip, and wherein the wire cover comprises an outer adhesive strip adhering to and covering the inner adhesive strip and extending outwardly beyond the wire ends, and further comprises an adhering element secured to the outer adhesive strip outwardly of the side edges of the bag for encasing the portions of the wire extending outwardly therefrom, the adhering element including a portion adhering to the outer adhesive strip beyond the wire ends for enclosing the wire ends.

2. A sampling bag comprising:

a flexible front wall and a flexible rear wall, the walls being joined together along a pair of spaced side edges and along a bottom edge extending between the side edges to define a cavity, with the sampling bag including a removable upper portion adapted to define an opening between the top edges of the front and rear walls leading into the cavity;

a deformable wire connected to a wall of the bag below the opening and extending laterally from each side of the bag, the wire terminating in a pair of wire ends each spaced outwardly from a side edge of the bag and being adapted to be bent inwardly to close the bag opening;

wherein the deformable wire is connected to the wall of the bag by means of an inner adhesive strip; and a wire cover connected to the wire outwardly of the side edges of the bag and extending beyond each wire end for enclosing the wire ends and preventing contact of the wire ends with the walls of the bag when the wire ends are bent inwardly to close the bag opening, wherein the wire cover comprises an outer adhesive strip adhering to and covering the inner adhesive strip and extending outwardly beyond the wire ends, and further comprises an adhering element secured to the outer adhesive strip outwardly of the side edges of the bag for encasing the portions of the wire extending outwardly therefrom, the adhering element including a portion adhering to the outer adhesive strip beyond the wire ends for enclosing the wire ends.

3. The bag of claim 2, wherein the deformable wire extends throughout the width of the bag and is connected to the rear wall of the bag, and further comprising a second deformable wire connected to the front wall of the bag, and wherein the cover extends beyond and encloses the ends of both the first-mentioned and second wires.

4. The bag of claim 2, wherein the outer adhesive strip has a width greater than that of the inner adhesive strip so as to adhere to a wall of the bag outwardly of the edges of the inner adhesive strip.

5. The bag of claim 2, wherein the deformable wire is connected to the rear wall of the bag and wherein the inner adhesive strip and the outer adhesive strip are also connected to the rear wall of the bag, and further comprising a second deformable wire connected to the front wall of the bag by means of a front inner adhesive strip, and wherein the cover extends beyond and encloses the ends of both the first-mentioned and second wire, and wherein the cover comprises a second outer adhesive strip fastened to the front wall of the bag cooperating with the first-mentioned outer adhesive strip fastened to the rear wall of the bag, wherein the front and rear outer adhesive strips extend along with the wires laterally outwardly from the side edges of the bag beyond the wire ends and are substantially coextensive with each other, wherein the portions of the second outer adhesive strip extending outwardly from the side edges of the bag comprise the adhering element, so that the front and rear outer adhesive strips encase the portions of the wires extending outwardly from the side edges of the bag, and include a portion extending beyond the wire ends for enclosing the wire ends.

* * * * *